US008657526B2

(12) United States Patent
Withers et al.

(10) Patent No.: US 8,657,526 B2
(45) Date of Patent: Feb. 25, 2014

(54) VEHICLE ARRESTING NET

(71) Applicant: Engineered Arresting Systems Corporation, Aston, PA (US)

(72) Inventors: Robert Withers, Logan Township, NJ (US); Richard L. Orner, Jr., Oreland, PA (US)

(73) Assignee: Engineered Arresting Systems Corporation, Aston, PA (US)

( * ) Notice: Subject to any disclaimer, the term of this patent is extended or adjusted under 35 U.S.C. 154(b) by 0 days.

(21) Appl. No.: 13/762,648

(22) Filed: Feb. 8, 2013

(65) Prior Publication Data

US 2013/0209168 A1 Aug. 15, 2013

Related U.S. Application Data

(60) Provisional application No. 61/596,860, filed on Feb. 9, 2012.

(51) Int. Cl.
*E01F 13/12* (2006.01)

(52) U.S. Cl.
USPC ..... 404/6; 49/263

(58) Field of Classification Search
USPC ..... 404/6, 9, 10; 49/263
See application file for complete search history.

(56) References Cited

U.S. PATENT DOCUMENTS

| | | | | | |
|---|---|---|---|---|---|
| 1,929,859 | A * | 10/1933 | Strauss | 246/29 R |
| 2,189,974 | A | 2/1940 | Buford | |
| 2,237,106 | A | 4/1941 | Minert | |
| 2,251,699 | A * | 8/1941 | Banschbach | 49/9 |
| 2,747,661 | A * | 5/1956 | Lucas | 160/10 |
| 4,947,764 | A * | 8/1990 | Rohr | 109/3 |
| 5,624,203 | A * | 4/1997 | Jackson et al. | 404/6 |
| 5,823,705 | A | 10/1998 | Jackson et al. | |
| 6,219,959 | B1 * | 4/2001 | Hsieh | 43/59 |
| 7,249,909 | B2 * | 7/2007 | Bibber | 404/6 |
| 2007/0258761 | A1 * | 11/2007 | Orner et al. | 404/6 |

FOREIGN PATENT DOCUMENTS

| | | | |
|---|---|---|---|
| BE | 1008980 | A6 | 10/1996 |
| WO | 2011009542 | A2 | 1/2011 |

OTHER PUBLICATIONS

International Search Report and Written Opinion dated Apr. 26, 2013 in Application No. PCT/US2013/025512.

* cited by examiner

*Primary Examiner* — Raymond W Addie
(74) *Attorney, Agent, or Firm* — Dean W. Russell; Kristin M. Crall; Kilpatrick Townsend & Stockton LLP

(57) ABSTRACT

Embodiments of the invention provide a gravity-lowered net that is housed above the surface onto which it is to be used, and is lowered by sliding weights that position the net to the correct height for use. Certain embodiments of the nets may be provided with one or more energy absorber elements associated with the net, which help enhance the energy absorptive capabilities of the net.

15 Claims, 7 Drawing Sheets

VEHICLE ARRESTING NET

CROSS REFERENCE TO RELATED APPLICATIONS

This application claims the benefit of U.S. Provisional Application Ser. No. 61/596,860, filed Feb. 9, 2012, titled "Vehicle Arresting Net, Gravity Lowered Net," the entire contents of which are hereby incorporated by reference.

FIELD OF THE INVENTION

Embodiments of the present invention relate generally to systems designed to stop selected vehicles in a non-lethal manner. One embodiment provides a gravity-lowered net that is housed above the surface onto which it is to be used, and is lowered by sliding weights that position the net to the correct height for use. Embodiments further provide a vehicle stopping net that has one or more energy absorbers associated with the net, integrated into the net, or interconnected with the net.

BACKGROUND

Vehicle arresting systems have been in development for many years. Some arresting systems utilize a solid barrier that is used to stop an overrunning vehicle. These barriers can often be lethal or detrimental to the occupants and may cause extensive damage to the vehicle. Other types of barriers are designed to be crushable, while still having enough strength that they can safely stop the vehicle. Such barriers are generally made of a deformable material that has a compressive strength sufficient to absorb the kinetic energy of a moving vehicle, while preventing serious injury or death to the vehicle occupants. However, these systems are typically permanent, can be expensive to install and maintain, and they are typically used along a road edge. They are not designed to be deployed across a highway or road.

However, in some instances, it is desirable to stop a vehicle that is not necessarily overrunning a roadway, but to instead stop a vehicle directly on the roadway itself. For example, it may be desirable to stop a suspicious vehicle from entering a restricted area; to protect high profile buildings or target areas that may be the subject of a terrorist attack, such as embassies, government buildings, military bases, and/or national monuments; to protect potentially dangerous locations, such an nuclear power plants or chemical production sites; to protect locations where the entering and exiting traffic needs to be controlled, mobile checkpoints, road blocks; or for any other number of reasons. One solution for stopping a vehicle directly on a roadway is an in-ground net installed in an excavated slot that can be raised when appropriate. However, the installation of such nets can be expensive and time consuming.

There have also been portable non-lethal arresting systems designed for use across a roadway, such as spike strips. Spike strips are provided over a particular access or departure point in order to puncture the tires of a vehicle. Although spike strips may be portable and inexpensive to manufacture and use, one of the limitations of spike strips is that the driver could continue to drive on steel rims. They do not physically arrest or stop the vehicle. Another system has been designed that also includes barbed spikes that puncture the tires, used in connection with a net that becomes wrapped or tangled beneath the vehicle wheels, preventing any further forward motion. Both of these systems must be manually positioned prior to use. They also use spikes or barbs which can be dangerous to the personnel selected to position the systems or pedestrians. They are also positioned directly on the roadway, which may not be desirable in some instances.

Accordingly, further improvements to non-lethal vehicle arresting systems are needed. It is desirable to provide a catch net design that can be pre-positioned for use, but that is easy to deploy and does not involve the expense of excavating the roadway. Such systems are desirably designed to stop a questionable vehicle in a safe and efficient manner.

BRIEF SUMMARY

Embodiments of the invention described herein thus provide a gravity-lowered net that is housed above the surface onto which it is to be used, and is lowered by sliding weights that position the net to the correct height for use. Certain embodiments of the nets may be provided with one or more energy absorber elements associated with the net, which help enhance the energy absorptive capabilities of the net.

In one embodiment, the catch net system for stopping vehicles includes at least two upright supports, a housing positioned between at least two upright supports, an upper and lower sliding weight provided per upright support, wherein the sliding weights are secured to a catch net, wherein prior to deployment, the catch net is contained in the housing, and wherein deployment of the net is assisted via gravity. Further embodiments provide a method for lowering a catch net via gravity, wherein the net also has a reversible winch and a lifting/lowering cable associated with the sliding weights, and wherein the lifting/lowering cable is activated (either electrically or manually) in order to raise or lower the net. In a further embodiment, there is provided a vehicle stopping net that has one or more energy absorbers associated with the net, integrated into the net, or interconnected with the net.

DETAILED DESCRIPTION

Figure 1:
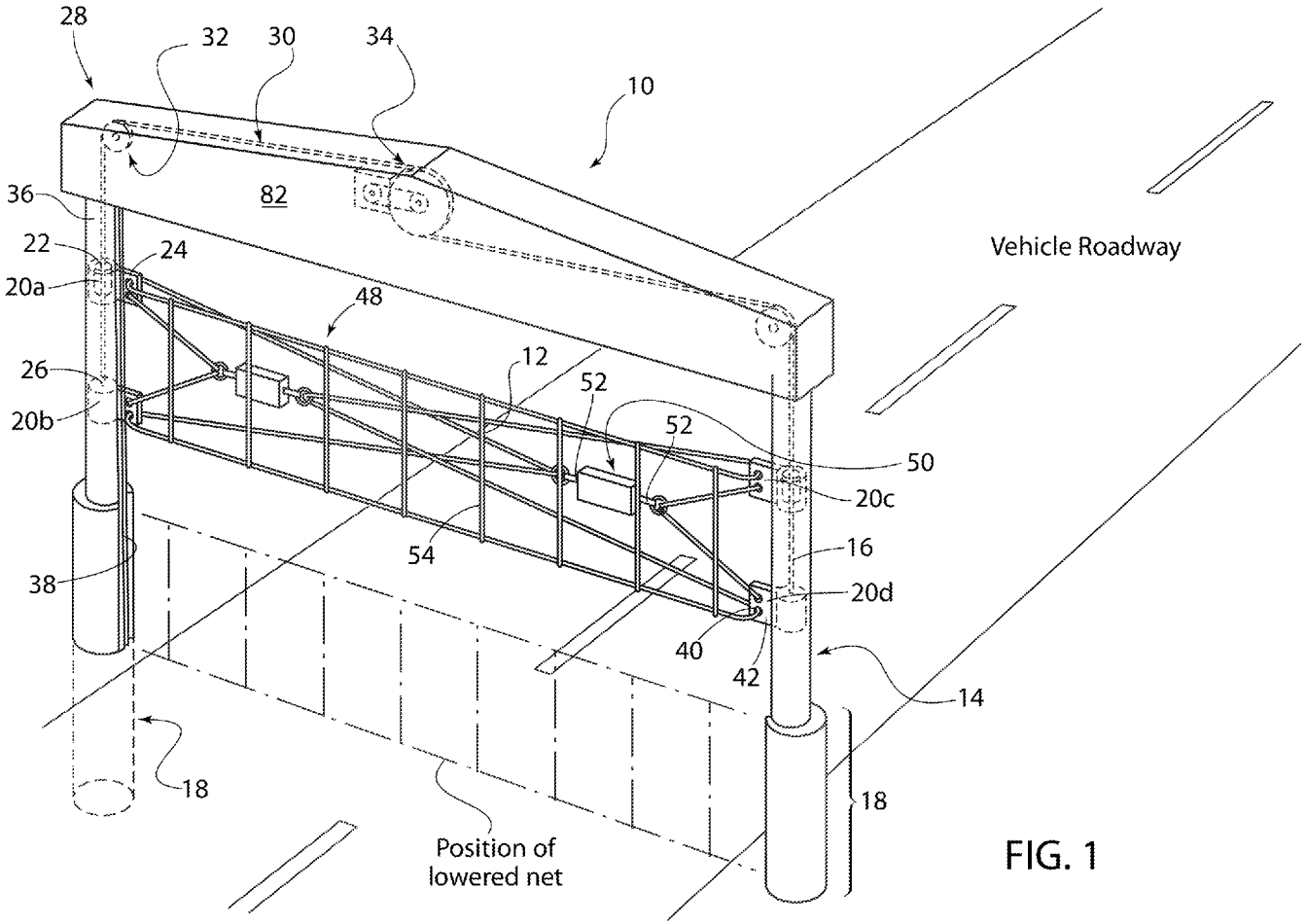
FIG. 1 shows a front perspective view of one embodiment of a gravity lowered catch net system.

Embodiments of the present invention provide a gravity-lowered catch net system 10. The system generally includes a catch net 12 that is positioned between two upright supports 14. As shown, the upright supports 14 may be provided as columns 16 that are positioned alongside the roadway, highway, or other surface on which a vehicle may travel. The columns 16 are shown as circular in cross-section, but it should be understood that they may take any form or shape, such as having a square, triangular, or rectangular cross-section, or any other shape that may provide an advantage to manufacture and/or use. They may be designed with any appropriate thickness, so long as the columns 16 have the desired strength. The columns 16 have a height that allows them to raise and support the catch net 12 high enough above the surface that the net 12 does not interfere with regular traffic flow when not in use. The columns 16 are shown as being supported by a base foundation 18 (which may or may not be positioned and/or cemented partially underground), but an alternate embodiment is to anchor the columns 16 with cables and guy-wires such that the system can be set up in remote locations and rapidly deployed. This embodiment would render the system more easily transportable, if desired. Columns 16 may be manufactured from any material that provides the strength required to support the catch net and to restrain the net when a vehicle is forced against the net, non-limiting examples of which may be steel, cement, combinations thereof, or any other appropriate material.

The upright supports 14 are generally provided in a perpendicular (or substantially perpendicular) nature to the roadway surface, which assists deployment of the net as described below, but they may alternately be provided at various angles to the surface if it is determined that such positioning would be advantageous.

Each of the columns or upright supports provides guidance for one or more sliding weights 20, which are positioned in relation to the upright supports 14. In the embodiment shown, there are two sliding weights 20 per side, such that four total sliding weights 20*a*, 20*b*, 20*c*, 20*d* are provided, but it should be understood that systems may be designed with varying numbers and designs of sliding weights 20. The weights, in conjunction with a control mechanism, accurately position the net to the correct height. They also provide a path for the net's cords to pay out during deployment of energy absorber (described in more detail below). The sliding weights 20 will be described with respect to one of the sides, but it should be understood that sliding weights on the opposite side have similar form and function. In one embodiment, at least two sliding weights 20 are provided per side, each having generally have the same features. Each sliding weight 20 has a sliding feature 22, which allows the weight to cooperate with the upright support 14. Each sliding weight 20 also has a net connection feature 24, which allows the weight to cooperate with the catch net 12.

First, the sliding feature 22 may be provided as an opening 26 through the approximate center in each weight 20 that cooperates with a lifting system 28. (Opening 26 may be offset as desired as well.) The opening 26 of each weight is sized to receive a lifting cable or rope 30 that cooperates with a sheave 32 (or stationary pulley) and a reversible winch 34. Activation of the winch 34 in one direction causes the lifting cable or rope 30 to wind over the sheave, and wrap around the winch 34. The sheave 32 is shown as being positioned at an upper edge of one of the upright supports 14. When the winch 34 is moved in a first direction, the sliding weight 20 is raised in order to lift the net. When the winch 34 is moved in a second direction, the sliding weight 20 is lowered in order to lower or drop the net. The lifting system 28 components may be located internally to the upright support 14, such that the upright support 14 has an inner cavity 36 to house components of the system 28. An open slot 38 may be provided along an outer surface of a substantial portion of the support 14 in order to accommodate the net connection feature 24 of the sliding weight 20.

In an alternate embodiment (not shown), the sliding feature 22 may be a larger opening in the weight 20 that allows the weight to travel on the outside of the upright support 14. In this embodiment, the upright support may have a smaller thickness than that shown in FIG. 1. The cable 30 of the lifting system 28 may be secured to the sliding weight 20 in any appropriate manner, and is generally positioned on the outside of the upright support in this embodiment (rather than in an inner cavity 36).

Figure 5:
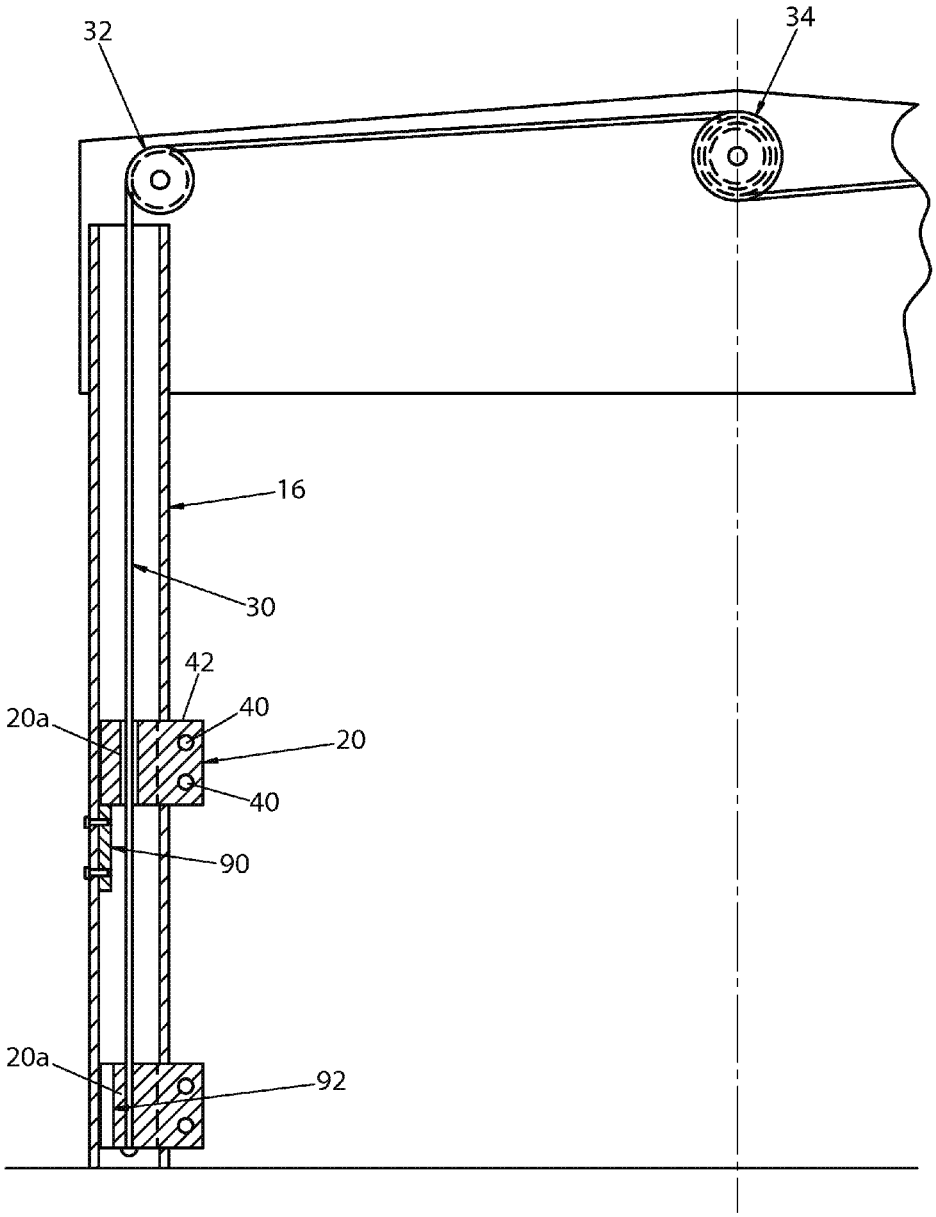
FIG. 5 shows one embodiment of a guiding system for the sliding weights.

Referring now to the sliding mechanics between the upright support/column and the sliding weights 20, the following description is related to the embodiment in which the sliding weight 20 is housed within an inner cavity 36 of the column 16, but it should be understood that this disclosure may be modified for alternate sliding weight embodiments to be effective. In the embodiment shown in FIG. 5, the column 16 may be provided with a stationary stop block 90 secured to an inner surface. The lower sliding weight 20*b* has a notch 92 that allows it to bypass the block 90 when being raised and/or lowered. The upper sliding weight 20*a* does not have such a notch, such that it is stopped by the stop block 90. When the net is deployed, the lower sliding weight 20*b* moves directly past the stop block and stops once it either hits the ground surface or is stopped by another, larger sized stop block (in the event that the net should stop before it reaches the ground surface, another stop block may be provided).

Figure 6:
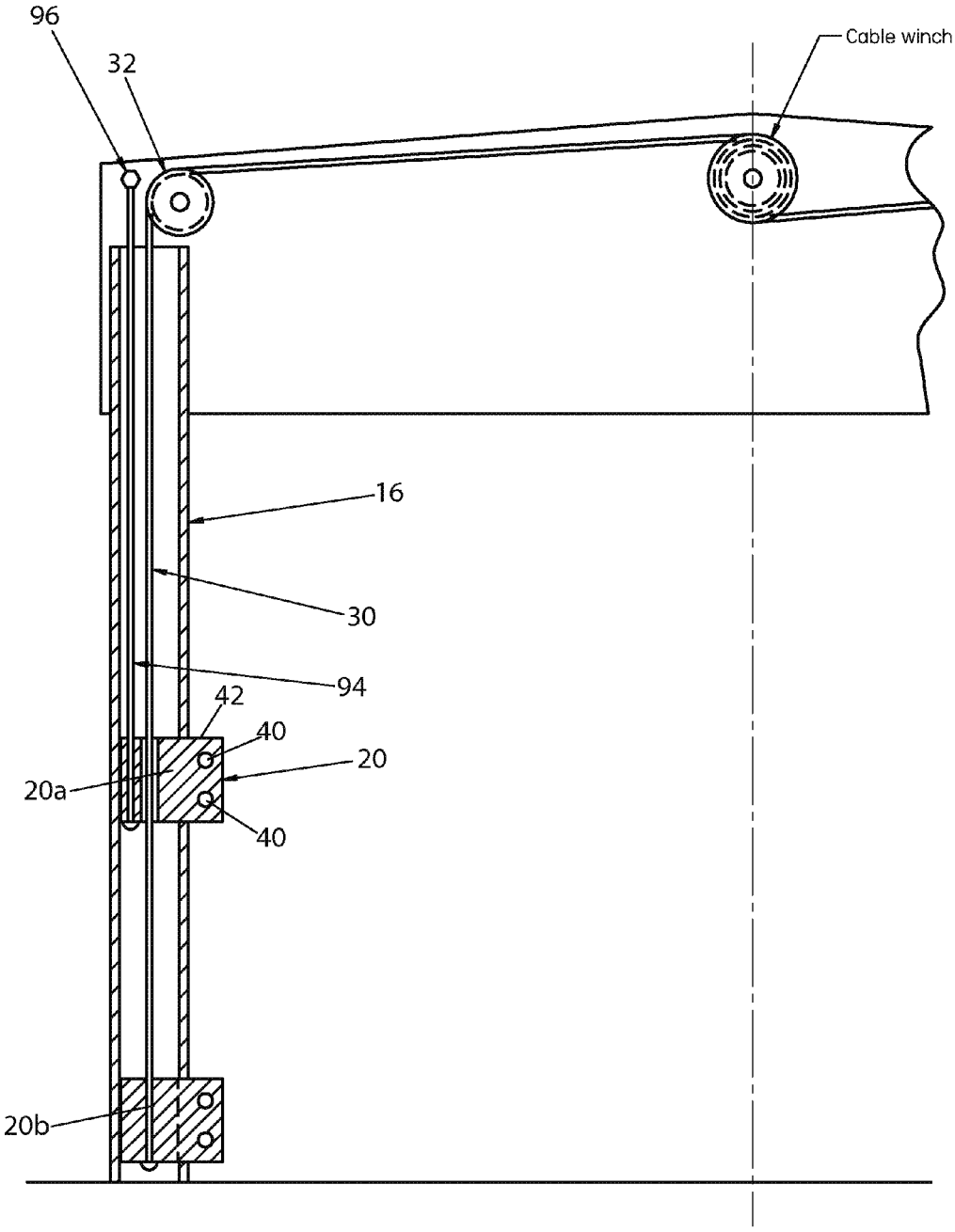
FIG. 6 shows an alternate embodiment of a guiding system for the sliding weights.

In the alternate embodiment shown in FIG. 6, the upper sliding weight 20*a* is associated with a drop limiter cable 94 that is secured at an upper end to an anchor bolt 96. When the weights 20*a*, 20*b* are dropped, the drop limiter cable 94 stops downward movement of the upper weight 20*a* once the length of the cable 94 has been reached. The lower weight 20*b* is allowed to drop the remainder of the extent, depending upon the length of the raise/lower cable 30.

Alternatively, the lower weight 20*b* may simply be connected to the upper weight 20*a* via a cord, with only the upper weight 20*a* being secured to the lifting system 28. In this embodiment (not shown), the upper weight 20*a* is controlled by the lifting system, 28 and the lower weight 20*b* is allowed to free fall once the lower weight reaches the extent of the lifting system cable 30. In this embodiment, there may be a retraction feature provided for the lower weight 20*b* in order to allow it to retract into the housing 82 (and not simply hang from the upper weight 20*a*).

Figure 2:
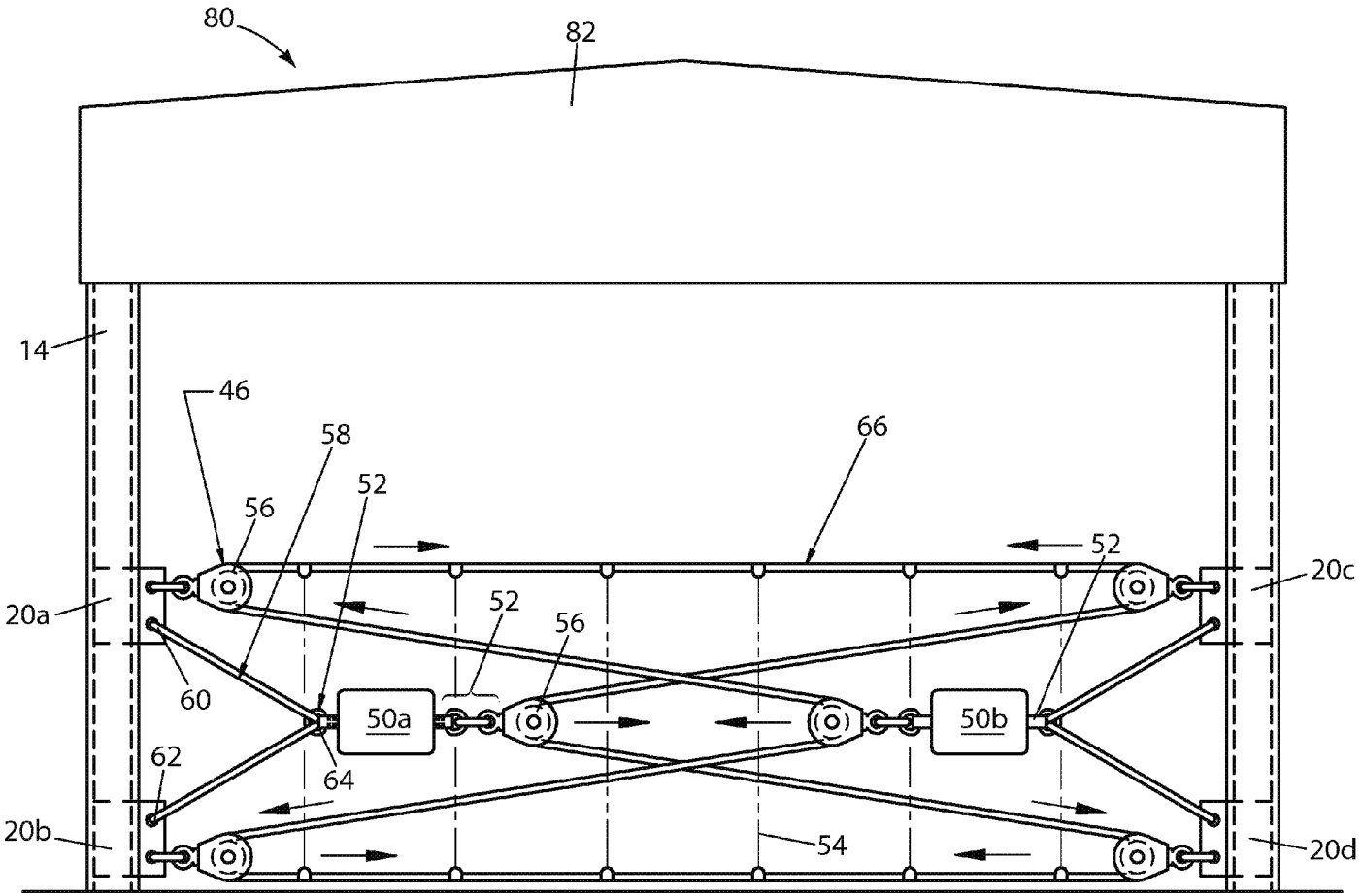
FIG. 2 shows a front view of a specific embodiment of a net configuration.
Figure 3:
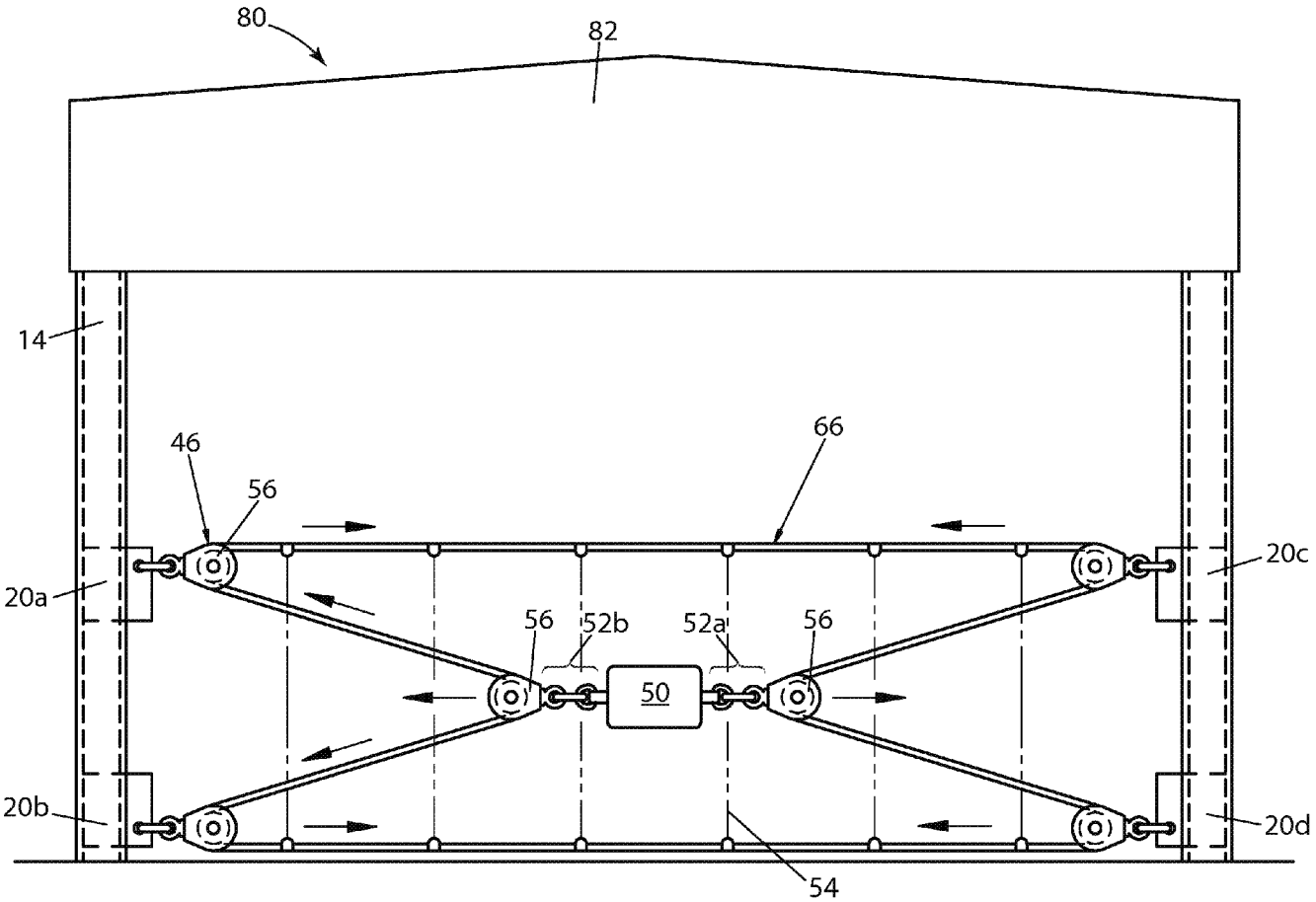
FIG. 3 shows a front view of an alternate embodiment of a net configuration.

Reference is now made to the connection between the sliding weights 20 and the net 12. The net connection feature 24 of the sliding weight 20 may be provided as one or more openings 40 in a tab 42 that extends from the weight 20. In the embodiment shown in FIGS. 1 and 5-6, the tab 42 is shown as having two openings 40, each of which supports or receives a net portion. It should be understood that fewer or more openings may be provided, depending upon the complexity of the next configuration to be used. Additionally or alternatively, the net connection feature 24 may further comprise a pulley system 46 that allows one or more net portions to slide through the sliding weight 20. The pulley system 46 may provide more "give" or leeway to the system and can allow easier sliding of the cords or ropes of the net through the net connection portion 24 and/or the pulley system 46. In an even further embodiment (not shown), the net connection feature 24 may comprise one or more outward loops or protrusions welded to or otherwise associated with the sliding weights 20 that receive various net portions, or any other feature that secures the net to the sliding weights. Referring now to the catch net 12 itself, the net may be formed as one or more suspended cords 48 that connect to an energy absorption device 50 located within the physical envelope of the catch net 12. The suspended cords 48 may be threaded or otherwise positioned through the net connection features 24 of the sliding weights 20 or through the pulley system 46. The energy absorption device 50 has one or more connection features 52 that allows the net cords 48 to be threaded or otherwise positioned therethrough. As shown in FIGS. 1-3, the catch net 12 includes a weave-work of one or more cords 48 associated with one or more energy absorbers 50. Although two energy absorbers are shown in FIGS. 1 and 2, it should understood that a single energy absorber may be used (as shown in FIG. 3), or that more than two energy absorbers may be used. The cords 48 may be positioned as shown in FIG. 1, with a series of cross-lengths secured to the net connection feature 24 and looped back to the connection features 52 of an energy absorber 50. There may also be an additional series of vertical cords 54 that are secured to upper and lower portions of the net 12.

FIG. 2 shows one specific embodiment of a net configuration. In this embodiment, a pulley system 46 is employed, with a pulley 56 secured to each of the sliding weights 20 and a pulley 56 secured to an inner portion of each energy absorber 50. (By contrast, the embodiment of FIG. 1 does not use a pulley system.) On each side of the net, a fixed cable 58 has one end 60 secured to an upper sliding weight 20*a* and a second end 62 secured to the lower sliding weight 20*b*. Its middle portion 64 is routed inwardly and secured to an outer edge of the energy absorber 50. Each of these securements is a fixed/stationary attachment. Another portion of the net is formed by a single cable element 66 that is guided through a first upper sliding weight 20*a* toward the opposite second upper sliding weight 20*c*, down to the connection feature 52 on a first energy absorber 50*a* (which in this embodiment, is a pulley 56, but need not be, as shown in FIG. 1), down to a third/lower sliding weight 20*d*, over to the opposite fourth/lower sliding weight 20*b*, back up to a connection feature 52 on a second energy absorber 50*b* (which in this embodiment, if a pulley 56, but need not be, as shown in FIG. 1), and back up to the first upper sliding weight 20*a*. The dark arrows in FIG. 2 illustrate the direction that the single cable element 66 travels when the net is impacted by a vehicle.

FIG. 2 also shows vertical elements 54 which may be secured to the single cable element 66 once positioned. Vertical elements may be secured to the net using any appropriate connection method, such as tied, sewn, heat welded, or any other appropriate method. It is also possible to provide vertical elements as detachable components, similar to the energy absorbers, that may clip or otherwise connect to the supporting cables/ropes that route through the weights and pulleys. This embodiment may allow quicker deployment, as well as provides an easily replaceable part in the event of damage. Additionally, the entire net portion could be a detachable component. This could include all the vertical elements along with the two horizontal pieces between the outer-most vertical pieces. The net may be provided as multiple component cords or it may be provided as a series of cords that are interconnected to one another via ties, stitching, or other connection features.

FIG. 3 shows an alternate net design. As with the embodiment shown in FIG. 2, a pulley system 46 is employed, with a pulley 56 secured to each of the sliding weights 20 and a pulley 56 secured to either side of the energy absorber 50. A single cable element 66 is guided through a first upper sliding weight 20*a* toward the opposite second upper sliding weight 20*c*, down through the connection feature 52*a* on the energy absorber 50 (which is shown as a pulley 56, but it should be understood that a pulley is not required, and that the cable 66 may be secured to the energy absorber using other attachment systems), down to a third/lower sliding weight 20*d*, over to the opposite fourth/lower sliding weight 20*c*, up to another connection feature 52*b* on the energy absorber 50 (which again, is shown as a pulley, but which may be provided as a different attachment system), and back up to the first upper sliding weight 20*a*. The arrows in FIG. 3 illustrate the direction that the single cable element 66 travels when the net is impacted by a vehicle. FIG. 3 also shows vertical elements 54 which may be secured to the single cable element 66 once positioned.

Figure 4:
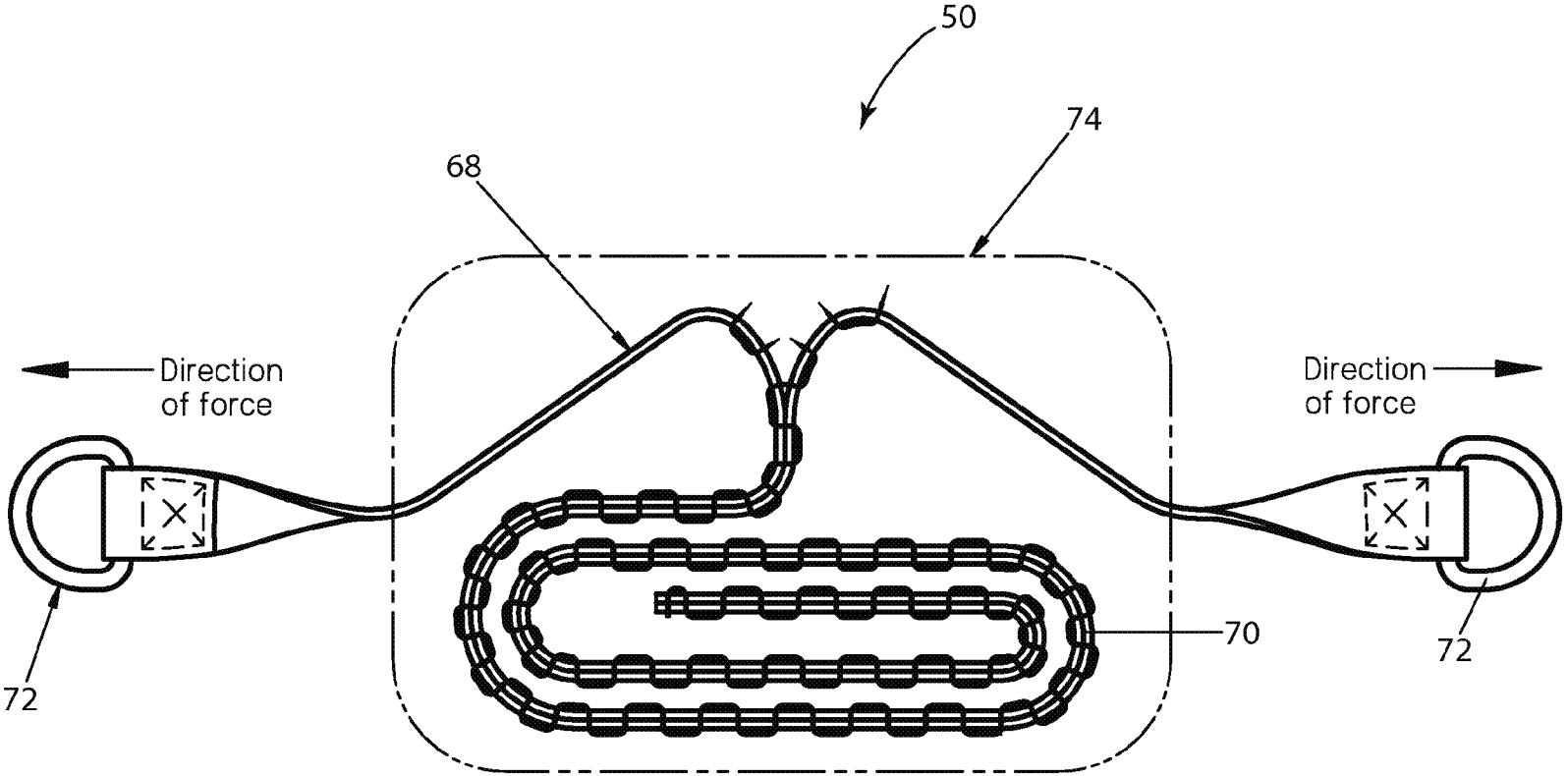
FIG. 4 shows a cross-sectional view of an energy absorber for use in connection with embodiments of the catch net system.

Referring now to the energy absorption devices 50 and other potential energy absorption structures, it should be understood that the energy absorption devices 50 are provided in order to permit the arrestment of moving vehicles while minimizing damages to vehicles and occupants. The devices 50 shown and described are merely embodiment of a potential device 50 and are shown for illustration purposes only. It should be understood that alternate energy absorption devices may be provided in addition to those shown, or in place thereof. One embodiment of an energy absorption device 50 that may be used in connection with the catch nets 12 described herein is shown in FIG. 4. This device 50 features two internal textile straps 68 that are stitched together in order to form a tear strap 70. A long length of consecutive stitches secures the two straps 68 to one another, such that when tension or force is applied to cause engagement of the device 50, the straps 68 tear from one another at the stitching. Each end of each textile strap 68 has a link 72 secured at the end thereof. Examples of how the links 72 may be secured to the net portions are shown in FIGS. 1 and 2. The completed tear strap 70 is housed in a weatherproof bag 74 and is incorporated into the catch net 12 as appropriate.

The one or more energy absorbers 50 are shown as contained within the envelope of the net. It/they may be sewn into the net, clipped into the net, or secured in any appropriate manner such that the energy absorber is associated with the net, integrated into the net, or interconnected with the net. Each energy absorber may be removable from the net, such that the net/energy absorber components may be disassembled. Additionally or alternatively, one or more energy absorber may be integrally formed with the net, such that textile straps that form the energy absorber are the same straps/cords that form portions of the net 12, just stitched together and positioned inside bag 74, and/or the energy absorber/net may be a combination thereof, such that the straps and net portions are sewn or stitched to one another as well as other portions of the net are formed separately.

Although the energy absorber is shown in FIGS. 1-3 as being associated with the net, integrated into the net, or interconnected with the net, it should be understood that the absorber could be located outside of the envelope of the net, such as being positioned on the ground adjacent to the supports, being positioned above or below the net, within the housing element 82 or at any other appropriate location. It is also possible for the energy absorber to be connected to the net via a cable/rope system.

Figure 7:
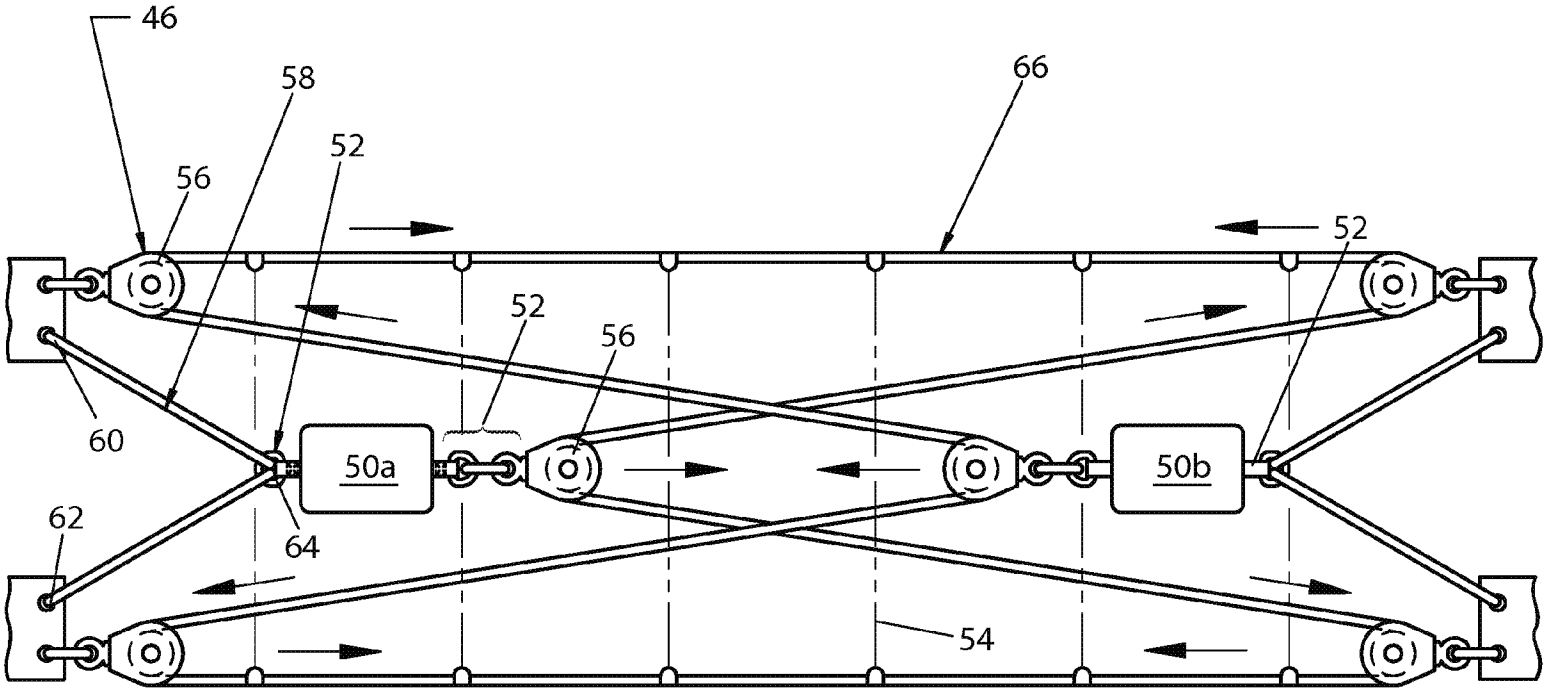
FIG. 7 shows an embodiment of a stand-alone catch net having two energy absorbers associated with the net, integrated into the net, or otherwise interconnected with the stand-alone net.

An alternate embodiment of the catch net is shown in FIG. 7. In this embodiment, the net is not secured to upright supports, nor does it have sliding weights. The net embodiment provides a catch net 12 having one or more energy absorbers 50*a*, 50*b* associated with the net, integrated into the net, or otherwise interconnected with the net. The energy absorbers may be formed and/or integrated into the net as described above. However, this net is not necessarily gravity lowered. It may be secured to existing poles or supports, not only to a frame 80/housing 82 component. This net may be positioned between existing structures, perhaps even between two trees, telephone poles, highway poles, electrical poles, and so forth. This embodiment provides the energy absorbing features combined with the net catching features in order to stop a vehicle in a non-lethal manner. It may be mounted or positioned in a matter of minutes, if necessary. The side portions of the net (where the sliding weights would otherwise be located) may consist of a tie feature, a strap feature, or any appropriate feature that allows the net to be secured to a stationary object. Although FIG. 7 shows pulleys as providing an additional connection feature, it should be understood that the net itself may comprise a portion of the connection feature or any other appropriate connection features are possible.

Additionally, the entire net portion could detachable, such that the vertical elements 54 and/or the energy absorbers 50 are removable. This may include all the vertical elements 54 along with the two horizontal cable elements 66 between the outer-most vertical pieces. In addition, the net could be designed such that the absorber is an integral component.

In use, when a fast-moving vehicle is captured by the net, the force of the vehicle causes to net to stretch, which tensions the links 72. This tension creates a tearing of the textile strips and this tearing creates a retarding motion for the net, while also allowing enough give to prevent death or serious injury to the vehicle occupants. The purpose of the net is to fully capture the vehicle and provide connection points to the cables attached to the absorber.

The materials for the catch net cords and the energy absorber cords may be any appropriate textile material, including but not limited to animal-based, plant-based and/or or synthetic-based fibers, examples of which may include nylon, high strength nylon, polymer-based materials, rayon, acetate, tencel, polyester, aramid, acrylic, spandex, polylactide, wool, silk, jute, coir, cotton, raffia, hemp, flax, bamboo, sisal, or any combination thereof, as well as others appropriate materials.

The catch net can be engaged by vehicles traveling in either direction, such that the system is bidirectional. The net can be slowly lowered onto the roadway for non-emergency purposes, or it may be quickly lowered (dropped) onto the roadway by use of gravity for an emergency arrestment.

Referring back to FIGS. 1-3, the overall frame 80 of the system is provided by upright supports 14 (shown as columns 16 in the Figures) and an optional upper housing element 82. Housing element 82 may be provided as a span between upright supports 14, and to also provide a space in which to house the net (for protection from the elements and to also render the system more visually pleasing). Housing element 82 may actually be used to disguise the presence of the catch net 12 contained therein, such that it helps create the appearance of a welcome sign that may be imprinted with an insignia, emblem, brand. The system 10 may also be incorporated into a guard stand or be positioned near a guard stand, such that easy activation of the system 10 is possible if a vehicle is suspect and needs to be safely and abruptly stopped.

The nets described herein are useful to stop a suspicious vehicle from entering a restricted area; to protect high profile buildings or target areas that may be the subject of a terrorist attack, such as embassies, government buildings, military bases, and/or national monuments; to protect potentially dangerous locations, such an nuclear power plants or chemical production sites; to protect locations where the entering and exiting traffic needs to be controlled, mobile checkpoints, road blocks; or for any other number of reasons.

If a suspect vehicle needs to be stopped, the catch net 12 is deployed by lowering the sliding weights 20 via the reversible winch 34. When deployed, the net may be dropped by activation of the winch 34. This can either be an electrical activation or a mechanical activation. For example, the winch 34 may be electrically associated with a control panel (either physically associated or wirelessly associated), such that activation of a button on the panel activated the winch. Alternatively, there is a fully manual emergency deployment option available, which does not require power. The net may be deployed by converting the potential energy of the raised weights into the kinetic energy required to position the net. The winch may simply be released manually and the net may drop. The winch could be mechanically released via an external cable routed to a latch system. This latching system could utilize a hand crank to turn the winch to re-position the net in the battery (inside the housing element) position. This would allow the system to function in the event of an electrical failure.

Once the vehicle has been safely stopped, the net may be reused (after any appropriate repairs are made) and a new energy absorber is positioned, if needed. The catch net 12 is retractable by reverse movement of the winch 34 back into the housing element 82 for storage until its next use.

Changes and modifications, additions and deletions may be made to the structures and methods recited above and shown in the drawings without departing from the scope or spirit of the invention and the following claims.

What is claimed is:

1. A catch net system for stopping a vehicle, comprising:

(a) at least two upright supports, (b) a housing positioned between the at least two upright supports;

(c) An upper and lower sliding weight provided per upright support, wherein each sliding weight is (i) configured independently to slide along its associated upright support via a lifting system and (ii) has a net connection feature secured to a catch net, wherein prior to deployment, the catch net is housed in the housing with the upper and lower sliding weights retracted into the housing, and wherein deployment of the net is assisted via gravity, such that the upper and lower sliding weights are distanced from one another to cause deployment of the net.

2. The catch net system of claim 1, further comprising at least one energy absorber associated with the catch net.

3. The catch net system of claim 1, wherein the at least one energy absorber is positioned within the net via links.

4. The catch net system of claim 1, wherein the catch net comprises a first cable element connected to the sliding weights via a pulley system.

5. A catch net system for stopping a vehicle, comprising:

(a) at least two upright supports, (b) a housing positioned between the at least two upright supports;

(c) two sliding weights provided per upright support, comprising an upper left sliding weight, a lower left sliding weight, an upper right sliding weight, and a lower right sliding weight, wherein the sliding weights are secured to a catch net, further comprising at least two energy absorbers, comprising a left energy absorber and a right energy absorber, with a cable element extending from the upper left sliding weight to the upper right sliding weight, to the left energy absorber, to the lower right sliding weight, to the lower left sliding weight, to the right energy absorber, back up to the upper left sliding weight, wherein prior to deployment, the catch net is housed in the housing, and wherein deployment of the net is assisted via gravity.

6. The catch net system of claim 5, further comprising a first fixed cable extending between the upper left sliding weight, the left energy absorber, and the lower left sliding weight; and a second fixed cable extending between the upper right sliding weight, the right energy absorber, and the lower right sliding weight.

7. The catch net system of claim 1, further comprising a reversible winch positioned within the housing.

8. The catch net system of claim 1, wherein the catch net is retracted into the housing via a lifting system.

9. The catch net system of claim 1, wherein a manual deployment system is provided in the event of loss of power.

10. A method for lowering a catch net via gravity, comprising;

(a) providing the catch net system of claim 1, further comprising a reversible winch and a lifting/lowering cable associated with the sliding weights, (b) activating the lifting/lowering cable in order to raise or lower the net.

11. The catch net of claim 2, wherein the one or more energy absorbers are secured to net cords via links, clips, stitching, or any combination thereof.

12. The catch net of claim 1, wherein the catch net is designed to be installed in relation to existing structures or stationary objects.

13. The catch net of claim 1, wherein the at least two upright supports each comprise a stop block, wherein the lower sliding weight comprises a feature that allows it to bypass the stop block, and wherein the upper sliding weight is stopped by the stop block upon deployment.

14. The catch net of claim 1, wherein the sliding weights are connected to one another via a raise/lower cord or cable.

15. The catch net of claim 14, wherein the upper sliding weight is associated with a drop limiter cable to stop downward movement of the sliding weights.

* * * * *